United States Patent [19]

McGuire

[11] Patent Number: 4,542,637

[45] Date of Patent: Sep. 24, 1985

[54] TUBE BENDING MANDREL

[75] Inventor: Samuel B. McGuire, Littleton, Colo.

[73] Assignee: Bending Products, Inc., Englewood, Colo.

[21] Appl. No.: 553,791

[22] Filed: Nov. 21, 1983

[51] Int. Cl.[4] ..... B21D 9/03

[52] U.S. Cl. ..... 72/466

[58] Field of Search ..... 72/367, 466

[56] References Cited

U.S. PATENT DOCUMENTS

| | | | |
|---|---|---|---|
| 1,045,797 | 11/1912 | Kiene | 411/200 |
| 1,287,371 | 12/1918 | McClay | 411/195 |
| 3,190,106 | 6/1965 | Spates | 72/466 |
| 3,286,503 | 11/1966 | Garrett | 72/466 |
| 3,455,142 | 7/1969 | Roberts | 72/466 |
| 3,750,455 | 8/1973 | Stange et al. | 72/466 |
| 4,315,423 | 2/1982 | McGuire | 72/466 |

*Primary Examiner*—Lowell A. Larson

*Attorney, Agent, or Firm*—Edwin L. Spangler, Jr.

[57] ABSTRACT

This invention relates to tube bending mandrels and, more particularly, to an improved version thereof characterized by a threaded connection between the tube-shaping ring and the necks of the ball-carrying links that functions in cooperation with an annular stop-forming rib and a retaining ring at opposite ends of the threaded link neck section to resist equally well both tension loads and compression loads while maintaining precise axial spacing between subassemblies in an assembly where, except for the links at opposite extremities, all parts remain fully interchangeable.

4 Claims, 4 Drawing Figures

TUBE BENDING MANDREL

The prior art tube bending mandrels are exemplified by my own patented structure shown in U.S. Pat. No. 4,315,423 and also U.S. Pat. Nos. 3,190,106 and 3,455,142 mentioned in the latter. I have found my own patented mandrel to be deficient in some respects when used in certain applications, especially those in which it must be force fed into the tube being shaped. The most common circumstance is, of course, that in which the permissible dimensional variations in the tube itself result in an undersize tube into which the mandrel must be forced. Less common, but more critical, is the situation in which a pair or series of closely-connected bends are to be made in the same tube. Under these circumstances, the mandrel must be force fed around the previous bend before a subsequent one can be produced.

Now, the central opening in the tube-shaping rings of my patented mandrel were smooth-bored as were the cylindrical necks of the links upon which these rings were mounted. During the bending operation in which the tube being shaped is pulled off the free or unsecured end of the mandrel at the same time it is being bent, no problem arises since the segmented ball on the opposite end of the link from the socketed neck is securely seated within its socket and the annular rib surrounding the socketed end thereof is easily capable of resisting the tension forces applied to the assembly as the tube-shaping ring is pulled against this rib. On the other hand, if my patented mandrel had to be force fed free-end-first into an undersized tube or around a previously-made bend, then the assembly was subject to failure for the reason that the tube-shaping ring was free to slide on the neck in the direction of the segmented ball thus moving into engagement with a retaining ring which was never intended to withstand such forces and all too often, did not. Specifically, when the mandrel assembly is in compression while being force-loaded into a tube, a solid metal-to-metal chain of links exists in which the segmented ball of one link is seated in the bottom of the socket in the link therebehind. The problem arises because with the tube-shaping rings being held back as they are forced into and through the tube, they back away from the annular ribs on the link necks that retain them when the assembly is under tension while, at the same time, moving against the retaining rings which are not designed to withstand these compression loads.

Looking first at the earlier of the two prior art patents other than my own that were mentioned previously, specifically, H & H Engineering Company's U.S. Pat. No. 3,190,106, their structure is subject to exactly the same deficiencies as mine, namely, the inability of snap ring 64 to resist the load imposed thereon when the tube-shaping ball slides on the neck of the link away from shoulder 47 when being force fed into a tube being shaped.

Prior art U.S. Pat. No. 3,455,142 assigned to Tools for Bending, Inc., on the other hand, solves the force-feeding problems by threading the tube-shaping ring onto the neck of the link but, in doing so, creates other serious problems which both the Spate's mandrel and mine have solved. Specifically, no lock ring or other element is disclosed for preventing relative rotation between the ring and the link screwed into the latter, sometimes in both directions (embodiment of FIGS. 1 and 2) and in at least one direction (embodiments of FIGS. 3 and 4). Since the axial spacing between the tube-shaping balls 12 is very critical to the operation of the mandrel, Roberts shows no way in his patent of controlling this critical parameter. I am aware, however, of the mandrel being marketed by Tools for Bending and it does, in fact, include means for preventing relative rotation between the tube-shaping ring and link in the form of a drilled hole bridging the interface therebetween and a lock pin within this hole. While this solves the relative rotation problem, it destroys the interchangeability of parts in that each ring and link become matched to the point where they cannot be interchanged without the possibility of changing the critical axial spacing between the several link and ring subassemblies. Moreover, even the matched subassemblies can be disassembled and reassembled incorrectly in that there is no assurance the threaded connection is not a turn or two off one way or another when the lock pin holes or more properly "half holes " come into juxtaposition. Apparently, the rings of FIGS. 3 and 4 that have annular ribs bordering the central openings therein do not have the problem of being reassembled properly but they must be matched to do so.

Robert's solid ball on his links creates problems in that tension loads must be borne by wire ring 62 which is subject to failure the same way my snap ring 74 and Spate's ring 64 are under compression loads. The threaded connection between the ring and link is subject to tremendous loads, both in tension and compression, in Roberts' primary embodiment shown in his FIGS. 1 and 2 assuming, of course, that his wire ring 62 does not give way first as the ball tries to pull out of its socket. The alternative embodiments of FIGS. 3 and 4 are better able to resist compression loads due to the presence of the ribs bordering the central openings in the rings but, as a matter of fact, these ribs break quite easily when made as thin as they must be to produce even a medium pitch length mandrel. The Roberts solid ball construction cannot be used even without a stop-forming rib on the ball to construct a mandrel with a pitch length as short as can be made using my construction.

I have found that the aforementioned deficiencies in my earlier threadless mandrel as well as those others discussed above can be overcome by providing each of the several links including the end link with an annular stop-forming rib on the end of the socketed neck remote from its segmented ball, threading the central opening in the tube-shaping ring and the neck of the link so that the former can be screwed onto the latter up snug against the rib, and finally securing the subassembly thus formed against relative axial movement by means of a retaining ring seated in an annular groove located on the neck at the opposite end of the threaded portion from the rib. By so doing, these elements cooperate with one another to remove the axial loads on the retaining rings when the mandrel is force fed into an undersize or previously bent tube while, at the same time, retaining all the capabilities it has always had in terms of withstanding tension loads without breaking, short-pitch embodiments, simplified assembly and, most important, interchangeability of components while maintaining precise dimensional integrity. Simply stated, no matter how the elements are assembled or reassembled, the axial spacing between adjacent tube-shaping rings so important to the functional operation of the mandrel is preserved.

It is, therefore, the principal object of the present invention to provide a novel and improved tube bending mandrel of a type especially adapted to be force fed into undersize tubes or those already containing one or more bends into and around which the mandrel must be pushed.

A second objective is to provide a device of the character described wherein the threads on the neck of the link and the mating threads on the inside of the tube-shaping ring cooperate with one another and with an annular stop-forming rib at the end of the link neck threads to both remove the axial load from a lock ring at the other end thereof and maintain the proper precise axial relationship between the elements of the subassembly thus formed.

Another object of the invention herein disclosed and claimed is to provide a bending mandrel possessing the capability of withstanding compression and tension loads equally well.

Still another objective is the provision of a multisegment tube-shaping mandrel wherein the elements are interchangeable.

Further objects are to provide a bending mandrel which is rugged, versatile and capable of producing small radius bends because of the short pitch length it can accommodate.

Other objects will be in part apparent and in part pointed out specifically hereinafter in connection with the description of the drawings that follows, and in which.

Figure 1:
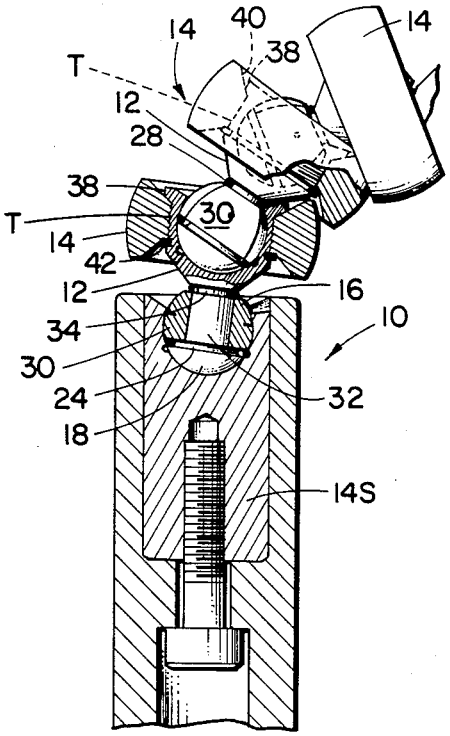
FIG. 1 is a fragmentary elevational view of the mandrel with portions thereof broken away and shown in diametrical section.
Figure 2:
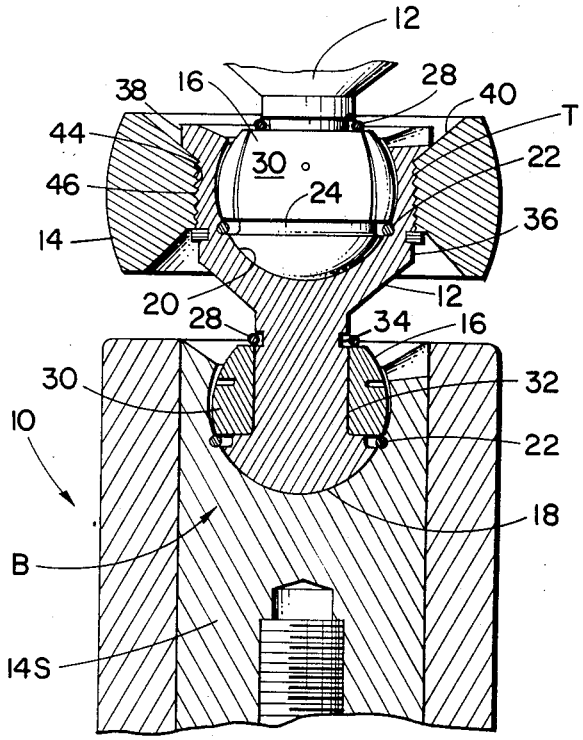
FIG. 2 is a fragmentary view similar to FIG. 1 but to a larger scale.
Figure 3:
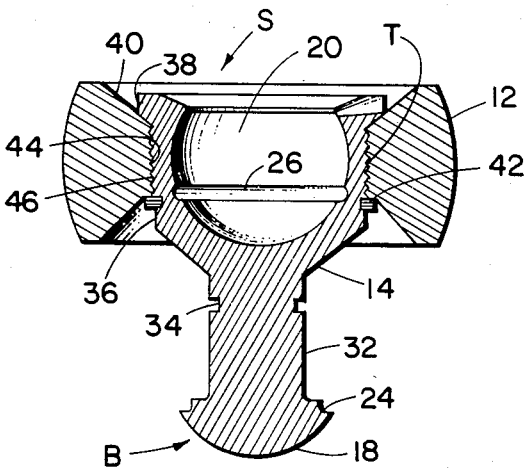
FIG. 3 is a detail in diametrical section to the same scale as FIG. 2 showing one of the center link and tube-shaping ball subassemblies; and, FIG. 4 is a detail much like FIG. 3 and to the same scale but showing the end link in elevation with portions of it and the tube-shaping ball threaded on the neck of the latter broken away and revealed in diametrical section.

Referring initially to FIGS. 1, 2 and 3 of the drawings, reference numeral 10 has been selected to broadly designate the tube-bending mandrel in its entirety while numerals 12, 14 and 16 specifically denote the link, tube-shaping ball and segmented ball, respectively. Each of the several link assemblies includes the link 12, a ball subassembly comprising a spherically-convex head 18 on one end of the link formed integral therewith plus segmented ball 16, and the tube-shaping ring 14. The end of link 12 remote from the ball contains a spherical socket 20 that is most clearly seen in FIG. 3 and which houses the ball subassembly previously referred to. A split ring 22 (FIG. 2) seats within a circular groove 24 formed at the base of the head 18 of link 14 between it and the segmented ball 16. A similar groove 26 is provided in the socket as seen in FIG. 3. Split ring 22 contracts into groove 24 and allows for limited universal movement of the ball within its socket in the manner shown in FIG. 1 but expands into socket groove 26 when the links are axially aligned as shown in FIG. 2 thus releasably holding the assembly in straight line relation while it is being fed into a tube to be shaped. This feature is not new and was present in my earlier patented construction. As a matter of fact, their is nothing new in the entire ball-and-socket connection, retaining ring 28 functioning to keep the ball segments 30 in place on the cylindrical shank 32 of the link behind head 18 as it seats within annular groove 34. No useful purpose would be served by going into further detail concerning the ball-and-socket universal connection since these details are readily ascertained by referring to my earlier patent that has been mentioned repeatedly already.

Other similarities also exist. For example, the neck 36 of each link lies at the opposite end thereof from its spherical head 18 and it terminates in an annular stop-forming rib or abutment 38. This abutment 38 always has as its purpose that of engaging the adjacent end 40 of the tube-shaping ring 12 to keep it from coming out of the socket end S of the link as opposed to its ball end B (see FIG. 3) when the assembly was placed under tension as the shaped tube is being pulled off the free end of the mandrel 10. In my earlier unit, however, the central opening in the ring was smooth-bored as was the cylindrical exterior of link neck 36. These opposed loose-fitting cylindrical surfaces allowed the ring to slide along neck 36 and contact retaining ring 42 when the mandrel was force loaded into an undersize or bent tube thus subjecting the latter to a load condition which could, and sometimes did, cause it to fail.

Figure 4:
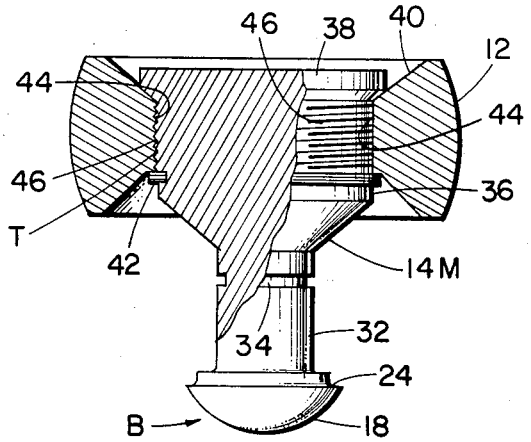

The novelty in the present mandrel lies in the fact that the ring 12 is no longer left free to slide along the neck and engage retaining ring 42, but instead, a threaded connection T exists therebetween. The central opening 44 in the ring 12 is internally threaded and the neck 36 of the link contains a mating threaded section 46 to receive the latter. The ring 14 when screwed up snug against the stop-forming rib 38 and held there by retaining ring 42 which prevents relative rotation between the ring and link that would adversely effect the axial spacing between those subassemblies of the mandrel results in an assembly that is fully capable of withstanding the loads to which it is subjected when force fed into the tube to the same degree it was always able to do under tension. All elements are interchangeable with the exception, of course, of the end link 14M shown in FIG. 4 which has no socket in it and the shank link 14S which has a different shape altogether for purposes of securing same in the bending die. The short pitch length attainable with my construction is also most advantageous in forming small radius bends that cannot be formed with bending mandrels like those previously described. For purposes of the present invention, it is immaterial whether the link has a socket (intermediate links 14 and shank link 14S) or does not (end link 14M of FIG. 4) since the novelty in the subassembly all lies in the cooperative action between the threaded connection T, the abutting relation between surface 40 of the tube-shaping ring and annular stop-forming rib 38 on the neck of the link 14, and the retaining ring 42.

What is claimed is:

1. The subcombination for use with other like subcombinations to form the bendable portion of a pipe bending mandrel which comprises: a rigid link having a front end and a rear end, ball-forming means on the rear end for detachable connection within a socket on the front end of an adjacent link therebehind effective to permit limited relative universal movement therebetween, a cylindrical neck forwardly of the ball-forming means, and stop-forming means on the front end; a tube-shaping ring having a cylindrical bore sized to receive the cylindrical neck of the link, a front face positioned and adapted to abut the stop-forming means when seated in place upon the cylindrical neck, and a rear face; a threaded connection interconnecting the neck of the link and the bore of the ring; and a retaining ring carried by the link in juxtaposition to the rear face of the ring, said retaining ring and stop-forming means cooperating with one another to maintain the tube-shaping ring in a preselected fixed axial position upon the link, and said threaded connection being effective to isolate said retaining ring from axial loads applied to said tube-shaping ring in a direction to force same rearwardly thereagainst while transferring said loads to the link.

2. The subcombination of claim 1 wherein: the stop-forming means comprises an annular rib.

3. The subcombination of claim 1 wherein the neck of the link is peripherally grooved to receive the retaining ring and wherein said groove is spaced rearwardly of the stop-forming means a distance closely approximating the length of the axial bore in the tube-shaping ring.

4. The subcombination as set forth in claim 1 wherein: the elements of one subcombination are interchangeable with like elements of other like subcombinations so as to cooperate with one another to form a new combination effective to maintain the same axial spacing between adjacent tube-shaping elements in the bendable portion of the mandrel.

* * * * *